United States Patent [19]

Wagner et al.

[11] Patent Number: 4,937,020

[45] Date of Patent: Jun. 26, 1990

[54] PRODUCTION OF VERY FINE POLYMER FIBRES

[75] Inventors: Wolfram Wagner; Peter R. Nyssen, both of Dormagen; Dirk Berkenhaus, Cologne; Hans-Theo van Pey, Lipp, all of Fed. Rep. of Germany

[73] Assignee: Bayer Aktiengesellschaft, Leverkusen, Fed. Rep. of Germany

[21] Appl. No.: 292,696

[22] Filed: Jan. 3, 1989

[30] Foreign Application Priority Data

Jan. 16, 1988 [DE] Fed. Rep. of Germany ..... 3801080

[51] Int. Cl.[5] ..... B05B 3/08; B05D 1/12

[52] U.S. Cl. ..... 264/6; 264/8; 264/12; 264/115; 425/7; 425/8

[58] Field of Search ..... 264/6, 8, 12, 211.1, 264/518, 115; 425/6, 7, 8

[56] References Cited

U.S. PATENT DOCUMENTS

| | | | |
|---|---|---|---|
| 2,931,422 | 4/1960 | Long | 425/8 |
| 3,254,977 | 6/1966 | Levecque et al. | 264/8 |
| 3,928,009 | 12/1975 | Perry | 425/8 |
| 4,058,386 | 11/1977 | Faulkner et al. | 65/6 |
| 4,237,081 | 12/1980 | Murphy et al. | 264/9 |
| 4,246,017 | 1/1981 | Phillips | 65/8 |
| 4,277,436 | 7/1981 | Shah et al. | 264/518 |

*Primary Examiner*—Jan H. Silbaugh
*Assistant Examiner*—Mary Lynn Fertig
*Attorney, Agent, or Firm*—Sprung Horn Kramer & Woods

[57] ABSTRACT

The polymer granular melt (1) is whirled out of a rotating nozzle head (6) through a plurality of exit holes (24) with fibre formation (32) and the fibres formed (9) are deposited on a collecting surface (12) in web form (15). This polymer melt is introduced into the nozzle head (6) under a preliminary pressure of 1 bar to 200 bar, preferably 1 bar to 50 bar. Furthermore, the fibres (32) are deflected by a high-speed gas stream (7, 8) in a radial direction at a radial distance of 10 mm to 200 mm from the exit holes (24) and, in the course of being deflected, are simultaneously drawn and stretched. The melt streams (32) exiting from the exit holes (24) can be additionally drawn by gas streams (26, 34) exiting in the vicinity of the exit holes (24) at the nozzle head (6) with a predominantly radial component before coming under the influence of the axial deflecting gas stream (7, 8).

13 Claims, 3 Drawing Sheets

PRODUCTION OF VERY FINE POLYMER FIBRES

BACKGROUND OF THE INVENTION

The invention relates to a process for producing very fine polymer fibres of finite length having an average fibre diameter of 0.1 to 10 μm, preferably 0.1 to 4 μm, from thermoplastic polymers. The basis of the process is whirling the molten polymer radially out of a rotating nozzle head through a plurality of exit holes with fibre formation and depositing the fibres formed on a collecting surface in web form.

Such whirler or centrifugal spinning processes are known and described for example in U.S. Pat. No. 4,277,436, U.S. Pat. No. 4,237,081, FR No. 1,298,508 and DE No. 3,105,784. More particularly, in the centrifugal spinning process of DE No. 3,105,784 use is made of an axially flowing cooling medium which cools the fibres formed and the spinning element. Consequently, this process is naturally only suitable for low-melting polymers of low viscosity. To avoid an excessively low pressure in the centre of the centrifugal field and the consequent aspiration of the fibres formed, it is necessary to employ comparatively low cooling air speeds. The cooling medium cannot therefore be used at the same time for stretching and drawing the fibres (attenuation).

Furthermore, EP No. 0,168,817 describes a centrifugal spinning process where the melt is evidently introduced under pressure into a nozzle rotating at relatively low circumferential speed. This makes it possible to produce relatively coarse filaments in a continuous manner. No drawing of the filaments by a dynamic gas effect going beyond the centrifugal attentuation takes place.

SUMMARY OF THE INVENTION

The invention has for its object to produce very fine polymer fibres from thermoplastic polymers with the aid of whirler or centrifugal spinning. Very fine polymer fibres for the purposes of the present invention are fibres having an average diameter of 0.1 μm to 10 μm, preferably 0.1 μm to 4 μm, and a finite length. This process should be useable within a wide viscosity range of 20 Pas to 1000 Pas of the polymer melt and be suitable for polymers whose melting point is within the range from 100° C. to 500° C.

This object is achieved starting from the existing centrifugal spinning process, wherein the molten polymer is radially whirled out of a rotating nozzle head through a plurality of exit holes with fibre formation, when, according to the invention, the molten polymer is introduced into the nozzle head under a preliminary pressure of 1 bar to 200 bar, preferably 1 bar to 50 bar, and the fibres are deflected in the axial direction by a high-speed gas stream at a radial distance of 10 mm to 200 mm from the exit holes and, in the course of being deflected, simultaneously undergo drawing and stretching.

Preferably, the melt streams exiting from the exit holes are additionally drawn by gas streams exiting in the vicinity of the exit holes at the nozzle head with a predominantly radial component before coming under the influence of the deflecting gas stream having a predominantly axial component. These radial gas streams are each advantangeously expelled at an angle of 0° to 45°, preferably 5° to 20°, relative to the direction of the melt exit holes and at a distance of 2 mm to 20 mm from the melt exit holes at a flow speed of 100 m/s to 600 m/s.

In a further development of the invention, the fibres are blasted by the deflecting gas stream at a flow speed of 50 m/s to 500 m/s at an angle of +60° to −60° relative to the axis of rotation and at a radial distance of 10 mm to 200 mm from the melt exit holes. For this purpose there are provided one or more gas nozzles which are each arranged around the melt exit holes.

Advantageously, the melt streams are whirled out of the exit holes at an angle of 45° to 90° relative to the axis of rotation.

In a further development of the invention, a sufficiently high centrifugal acceleration is generated in a chamber upstream of the melt exit holes in addition to the acceleration in the nozzle head due to the preliminary pressure on the polymer melt that a pressure of 1 bar to 200 bar, preferably of 1 bar to 50 bar, prevails in the chamber. This centrifugal acceleration acts as an additional pressure which leads to a higher rate of melt flow in the exit hole.

It has further proved to be advantageous to set the ratio of the radial gas flow rate to the axial gas flow rate at a value between 0 and 5, preferably between 0.4 and 2.

It has also been found that the distance along which attenuation of the fibres takes place can be extended if the temperature of the radial gas flow is equal to or greater than the temperature of the melt exiting from the exit holes. This avoids cooling the melt streams immediately on exit from the holes; that is, cooling does not start until later.

The process according to the invention has proved suitable in particular for producing very fine fibres from polyurethane, polyolefine, polyamide, polyesters, polycarbonate, polyphenylene sulphide and thermotropic LC polymers.

The invention gives the following advantages:

The process is not limited to a relatively narrow viscosity range, but permits the processing of polymer melts within a viscosity range from 20 Pas to 1000 Pas. Furthermore, the process permits the production of very fine fibres from polymers whose decomposition temperature is only a little above the solidification temperature of the melt. In practice this means that it is even possible to process polymers which have only a small temperature range utilizable for filament formation.

Further advantages of the process according to the invention reside in the fact that fibres are obtained without coalesced, twisted or thick places. Furthermore, it is possible to produce fibres of high fineness and substantial length (length/diameter $=10^3$ to $10^6$). It has also been observed that, compared with existing processes of the art, very much higher throughputs within the range from 0.001 g/min to 2 g/min per hole are obtainable. The fibres produced by the process according to the invention are also notable for excellent mechanical properties (high strength) and are easy to process further into webs.

BRIEF DESCRIPTION OF THE DRAWINGS

In what follows, working examples of the invention are described in more detail by reference to drawings, in which.

DETAILED DESCRIPTION OF THE INVENTION

Figure 1:
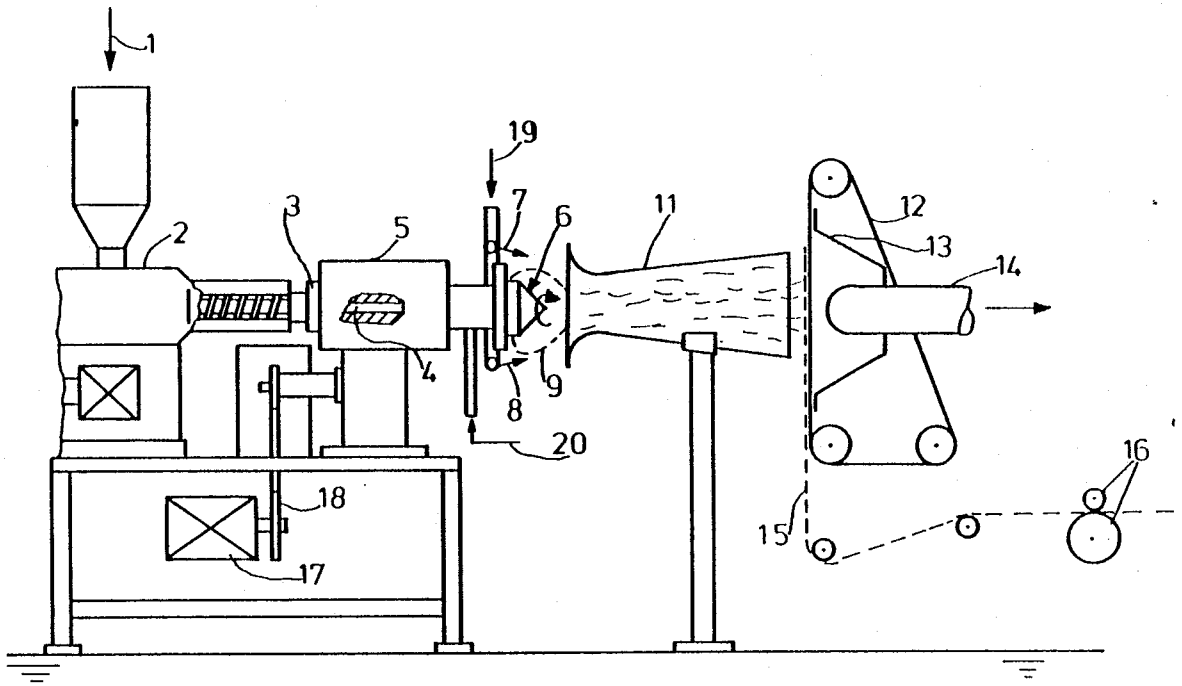
FIG. 1 shows a process diagram for an installation for carrying out the process according to the invention.

According to FIG. 1, polymer granules 1 are melted in an extruder 2 and passed under a constant pressure within the range from 1 to 200 bar via a rotating seal 3 into a centric, rotating melt channel 4 in a housing 5 which also serves as a storage reservoir. The melt channel 4 is in connection with a rotating nozzle head 6 whose rotational speed is within the range from 1000 to 11,000 $min^{-1}$, preferably 3000 to 11,000 $min^{-1}$. The melt exits radially from the nozzle head 6 through small holes at an angle of 45° to 90° relative to the axis of rotation. Owing to the melt pressure employed within the range from 1 bar to 150 bar, preferably 1 bar to 50 bar, continuous mass flows of 0.001 g/min to 5 g/min, preferably 0.01 to 1 g/min, per hole are formed. These mass flows come under the influence of a deflecting gas stream 7, 8 which exits from the nozzle head 6 and predominantly has an axial component and, in the course of being deflected, are attenuated and drawn into very fine fibres of finite length having a diameter of 0.1 μm to 4 μm. The very fine fibres 9 then pass through a collecting diffuser 11 onto a collecting belt 12 with a gas aspiration 13, 14 where they are formed into a web 15 which, if necessary, is further consolidated between heated rolls 16.

The rotating nozzle head 6 including the melt channel 4 influent therein is driven by a motor 17 via associated V-belt gearing 18. The nozzle head 6 is conveniently heated by electric induction, while the melt channel 4 is heated in the storage area 5 by resistance heating wires. The deflecting gas 7, 8 is delivered to the nozzle head 6 via connections 19, 20.

Figure 2:
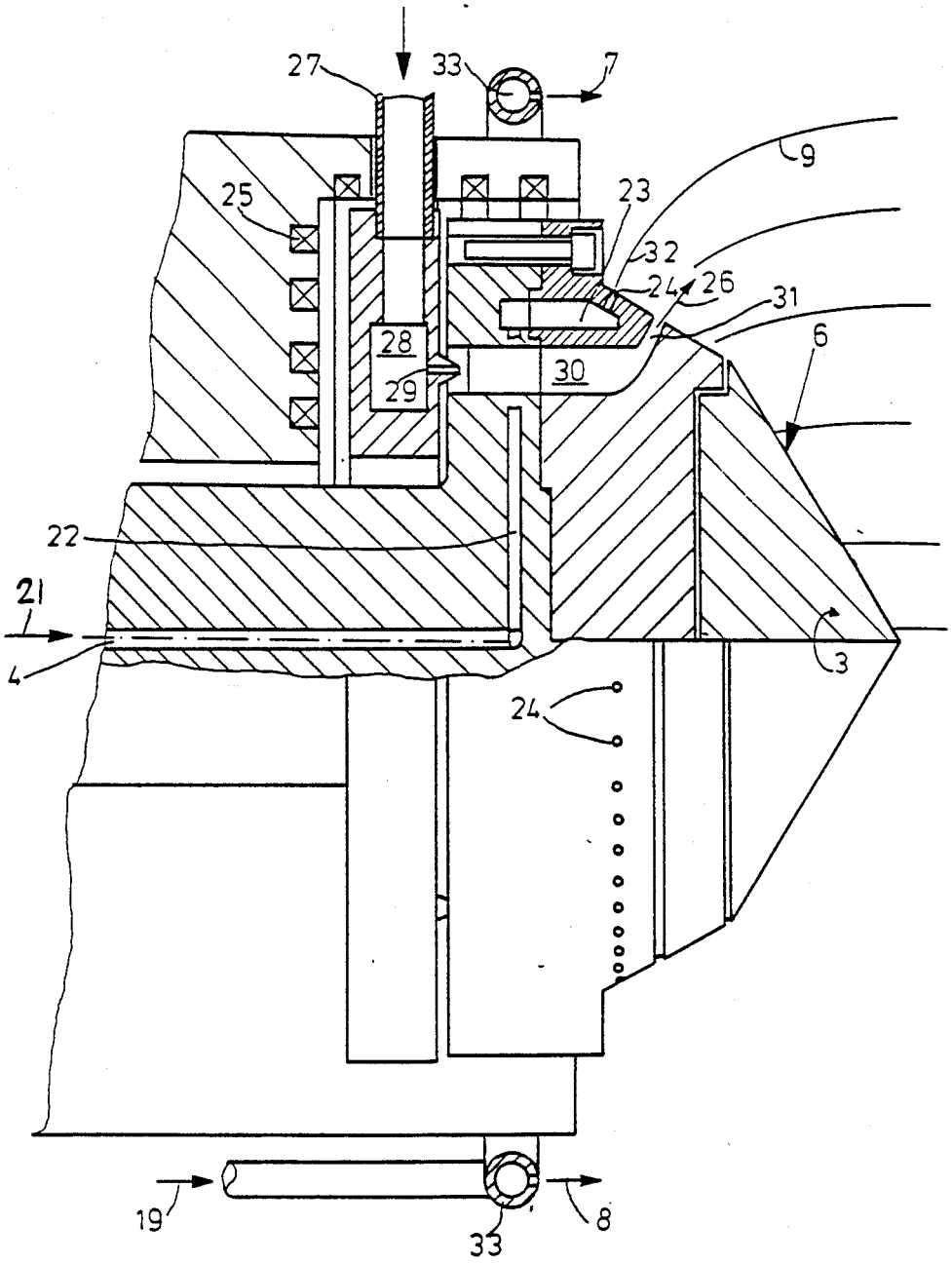
FIG. 2 shows a nozzle head featuring slot flow against the melt streams from one side and FIG. 3 shows a nozzle head featuring radial blasting of the melt streams from two sides.

According to FIG. 2, the melt streams exiting from the exit holes in the nozzle head 6 are additionally drawn by radial gas streams before coming under the influence of the deflecting gas streams 7, 8. For this purpose the rotating nozzle head 6 was further developed. The polymer melt 21 here is passed at a temperature required to set the desired viscosity above the physical melting point under a pressure of 1 to 200 bar into the centric rotating melt channel 4 and from there via radial passages 22 into a chamber disposed within the nozzle head 6 and upstream of the melt exit holes 24. The centrifugal force has the effect that the pressure in the antechamber 23 is greater than the pressure imparted by the extruder, which leads to an increased rate of melt flow in the exit hole 24. The pressure in the antechamber 23 is preferably 1 bar to 150 bar, so that the melt viscosity in the hole 24 is reduced by the flow and higher throughputs become obtainable. To set the desired melt temperature at the exit of hole 24 the nozzle head is heated with an electric induction heating system 25. The gas supply for the radial gas streams 26 takes place at connection 27. The pressurized gas is passed from the connection 27 into a compressed gas distribution chamber 28 and flows from there through a plurality of gas holes 29 into a compressed gas nozzle chamber 30. In the course of this passage, the heated air is brought approximately to the speed of sound and exits via slot 31 in the nozzle head at approximately the same speed in the form of radial gas stream 26. Here it has been found to be favourable if the radial gas stream exits at an angle of 0° to 45°, preferably 5° to 20°, relative to the direction of the melt exit passages 24.

The polymer melt streams exiting from the melt exit holes 24 form primary filaments within the centrifugal field in which the heated radial gas streams 26 flowing in almost the same direction either prevent or specifically control any cooling and, in addition to the centrifugal attenuation of the primary filaments, bring about a dynamic gas attenuation forming without breakage very fine primary filaments 9 a few μm in diameter. The gas streams 26 additionally prevent coalescence of the primary filaments 32 and further ensure that the primary filaments are not prematurely deflected in an axial direction. The direction of the radial gas streams 26 is advantageously chosen in such a way that the geometric intersection between the gas flow direction and the direction of the primary filaments 32 is located at a radial distance from the centrifugal axis where the filaments 32 have attained their maximum circumferential speed.

At a radial distance of 10 mm to 200 mm from the exit holes 24 the primary filaments 32 come under the influence of a deflecting gas stream 7, 8 flowing in an axial direction and are conveyed further in an axial direction. The deflecting gas streams 7, 8 have a direction of +60° to −60°, preferably +30° to −30°, relative to the axis of rotation and a speed of 50 to 500 m/sec. The deflecting gas streams 7, 8 exiting from the blast ring 33 have a temperature which is below the melting point, preferably below the solidification point, of the polymer material. The deflecting gas streams have the effect of cooling the primary filaments 32 and drawing them to the desired final fibre diameter. At the same time the primary filaments 32 break, forming fine polymer fibres 9 of finite length which are then further processed into a web 15 as described in conjunction with FIG. 1.

Figure 3:
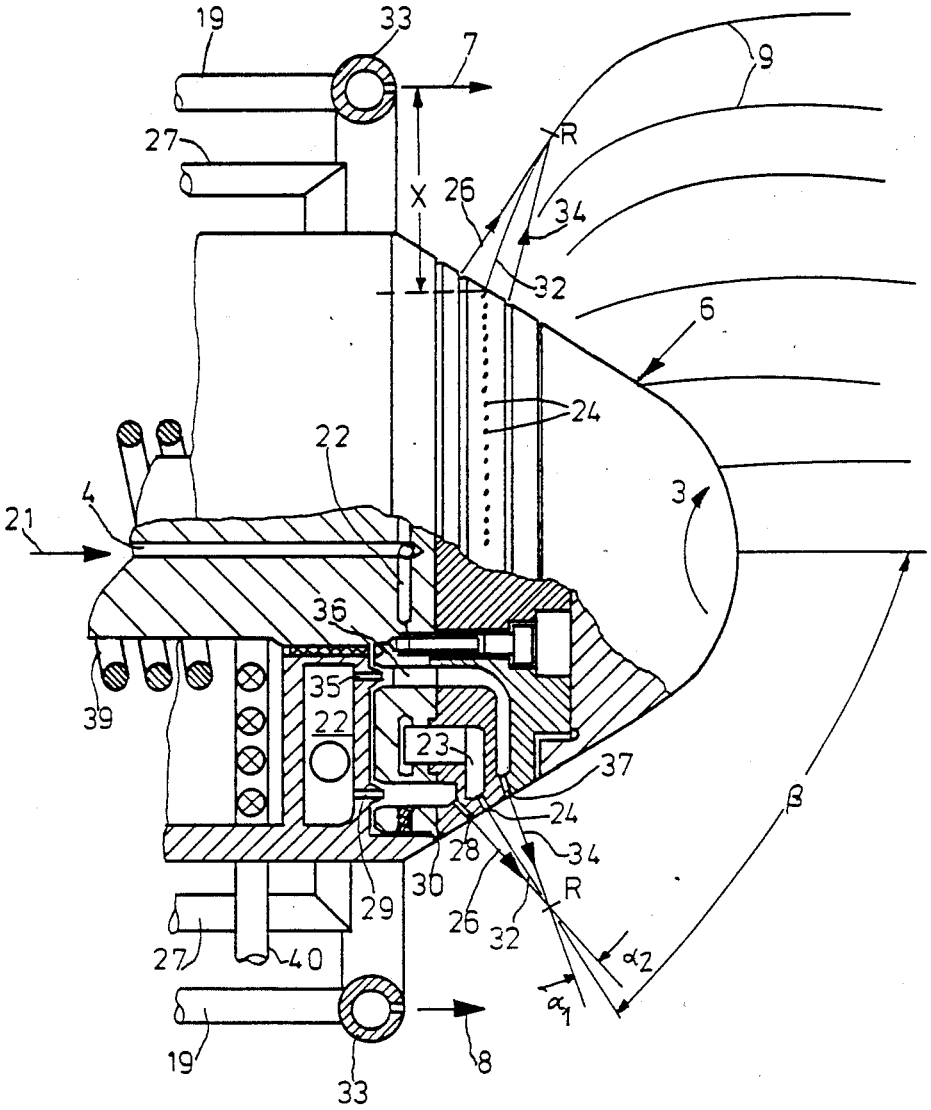

A further variant of the process is described hereinafter by reference to FIG. 3. The primary filaments are in principle produced by the same process as with the apparatus of FIG. 2; in contradistinction from the aforedescribed process, however, the primary filaments 32 are blasted not from one side but from two sides by flanking radial gas streams 26 and 34. For this purpose, two gas passages 29 and 35 lead from the compressed gas distribution chamber 28, which is connected to the gas supply 27, and enter into separate compressed gas nozzle chambers 30 and 36. The pressure in these two chambers is within the range from 1.5 to 3 bar. Instead of a slot 31 for the exit of the radial gas stream (FIG. 2) there are now two separate gas exit holes 37, 38 adjacent to the melt exit hole 24 which are in connection with the compressed gas nozzle chambers 30, 36. The gas emerges from the holes 37, 38 at a speed above the speed of sound in a radial direction at an angle $\beta$ of 0° to 90°, preferably 30° to 90°, relative to the axis of rotation on both sides of the melt exit hole. The gas exit passages 37, 38 each form an angle $\alpha_1$ or $\alpha_2$ of 0° to 45°, preferably 5° to 20°, with the direction of the melt exit passage 24.

The direction of the radial gas jets 26, 34 flanking the primary filaments 24 is advantageously chosen in such a way that the gas jets impinge on the primary filament 32 at a point R where the primary filaments have not as yet attained their maximum possible circumferential speed. This ensures that the primary filaments 32 are attenuated not only by centrifugal forces but also, virtually simultaneously, by gas-dynamical forces. The term "attenuated" here is to be understood as meaning that the melt streams are drawn and stretched. The temperature of the radial gas jets 26, 34 is again set sufficiently high for virtually no cooling to occur along this attenuation zone.

Thereafter the primary filaments 32 are deflected in an axial direction as in the process of FIG. 2 by axial deflecting gas streams 7, 8 exiting from the blast ring 33. The angle of these deflecting gas streams is again +60° to −60°, preferably +30° to −30° (measured relative to the axis of rotation of the nozzle head). The distance x of the point of exit of the deflecting gas jets 7, 8 from the melt exit hole 24 is 10 mm to 200 mm, preferably 20 mm to 100 mm. The deflecting gas jets 7, 8, as well as bringing about a change in direction, are responsible for cooling, stretching the polymer filaments 9 further and finally breaking them.

The polymer melt 21 is again fed in through the central, rotating melt channel 4 and passes through the radial melt distribution passages 22 into the antechambers 23 connected to the melt exit holes 24. For heating, the nozzle head 6 is equipped with a heating coil 39 which is electrically connected via line 40.

In summary, the important process criteria are specifically mentioned once more:

1. The polymer melt is introduced into the rotating nozzle head under a relatively high preliminary pressure.

2. The deflecting and cooling of the primary filaments by deflecting gas streams only takes place after passage through a radial drawing zone in which the polymer filaments are blasted with hot air having a predominantly radial component.

3. The radial hot gas streams are delivered into the centre of the rotating nozzle head and are radially divided within the nozzle head.

4. The radial hot gas stream is blasted at the primary filaments from one or both sides.

5. The nozzle head rotates at a high circumferential speed of 20 to 150 m/sec.

6. The blasting with the deflecting gas stream preferably takes place at sonic or supersonic speed.

7. The rotating nozzle head is not cooled but heated.

WORKING EXAMPLES

Example 1

Experimental apparatus in accordance with FIG. 2

Isotactic polypropylene having an MFI 190/5 of 60 g/min was melted in the extruder at a temperature of 210° C.

The spinning or whirler head temperature was 260° C. The melt pressure within the whirler head was 10 bar, which gave a melt throughput of 0.9 g per minute per exit hole. The speed of rotation of the whirler head was 9700 $min^{-1}$. The primary melt filaments exiting from the holes were drawn with a radial hot air stream of 380 $m^3$(S.T.P>)/h at 280° C. This was followed by axial deflection with 500 $m^3$(S.T.P.)/h of cold air at 20° C. The very fine fibres thus spun had an average fibre diameter of 1.1 μm, a standard deviation of 0.4 μm and a length of more than 50 mm. On extension to less than 60% the individual fibre strength was 300 to 800 MPa. Webs having basis weights of 2 to 60 g/$m^2$ were produced, these webs being notable for high uniformity, an absence of autogeneous web formation and high web strength.

Example 2

Experimental apparatus in accordance with FIG. 2

Nylon 6 having a relative viscosity of $\mu_R=3.1$ was melted in the extruder at 270° C. and spun at a spinning temperature of 300° C. with a melt throughput of 0.1 g per minute per exit hole by the process according to the invention under a preliminary pressure on the melt of 25 bar. Radial drawing was effected with 300 $m^3$(S.T.P.)/h of hot air at 295° C. Axial deflection was effected with 500 $m^3$(S.T.P.)/h of cold air at 20° C. This gave very fine fibres 2 μm in thickness, 0.8 μm in standard deviation and of substantial length. The strength on extension to less than 40% was 400 to 900 MPa.

The process according to the invention is suitable in particular for producing fine, very fine and ultrafine fibres from thermoplastic materials, such as polyurethane, polyolefine, polyamide, polyesters or thermotropic LC polymers.

We claim:

1. In a process for producing very fine polymer fibres of finite length having an average fibre diameter of 0.1 μm to 10 μm from thermoplastic polymers by whirling the molten polymer radially out of a rotating nozzle head through a plurality of exit holes with fibre formation and depositing the fibres formed on a collecting surface in web form, the improvement comprising: introducing the molten polymer into the nozzle head under a preliminary pressure of 1 bar to 200 bar, deflecting the fibres in the axial direction by a high-speed axial gas stream at a radial distance of 10 mm to 200 mm from the exit holes to simultaneously draw and stretch same in the course of being deflected and additionally drawing the melt streams exiting from the exit holes by radial gas streams exiting in the vicinity of the exit holes at the nozzle head with a predominantly radial component before coming under the influence of the axial gas stream having a predominantly axial component.

2. The process according to claim 1, wherein the radial gas streams each exit at an angle of 0° to 45°, relative to the direction of the melt exit passages and at a distance of 2 mm to 20 mm from the melt exit holes.

3. The process according to claim 2, wherein the radial gas streams exit at a flow speed of 100 m/s to 600 m/s.

4. The process according to claim 1, the fibres are deflected by the axial gas stream at a flow speed of 50 m/s to 500 m/s at an angle of +60° to −60° relative to the axis of rotation.

5. The process according to claim 1, wherein the melt streams are whirled out of the exit holes at an angle of 45° to 90° relative to the axis of rotation.

6. The process according to claim 1, further comprising producing, in addition to the acceleration of the melt stream caused in the nozzle head by the preliminary pressure on the polymer melt, a pressure of 1 bar to 200 bar in a chamber upstream of the melt exit holes by a sufficiently high centrifugal acceleration.

7. The process according to claim 1, wherein the ratio of the radial gas flow rate to the axial flow rate is set at a value between 0 to 5.

8. The process according to claim 1, further comprising heating the radial gas flow to a temperature which is equal to or greater than the temperature of the polymer melt at the exit holes.

9. The process according to claim 1, wherein the thermoplastic material is polyurethane, polyolefine, polyamide, polyesters, polyphenylene sulphide or thermotropic LC polymers.

10. The process according to claim 1, wherein the molten polymer is introduced under a preliminary pressure of 1 bar to 50 bar.

11. The process according to claim 2, wherein the radial gas streams exit at an angle of 5° to 20°.

12. The process according to claim 6, wherein the pressure in the chamber upstream of the melt exit holes is from 1 bar to 50 bar.

13. The process according to claim 7, wherein the ratio is between 0.4 to 2.

* * * * *